United States Patent [19]

Park

[11] Patent Number: 4,662,186

[45] Date of Patent: May 5, 1987

[54] REFRIGERATOR APPARATUS

[76] Inventor: Joon Park, 1128 E. Raleigh St., Glendale, Calif. 91205

[21] Appl. No.: 873,087

[22] Filed: Jun. 3, 1986

Related U.S. Application Data

[63] Continuation of Ser. No. 766,511, Aug. 19, 1985, abandoned.

[51] Int. Cl.[4] ..... F25D 23/02

[52] U.S. Cl. ..... 62/265; 62/408; 62/441

[58] Field of Search ..... 62/265 O, 441, 442, 62/408, 267

[56] References Cited

U.S. PATENT DOCUMENTS

| | | | |
|---|---|---|---|
| 1,404,961 | 1/1922 | Hummel | 62/265 |
| 1,726,631 | 9/1929 | Shipman | 62/265 |
| 2,044,011 | 6/1936 | Nones | 62/265 |
| 2,051,733 | 8/1936 | Moore et al. | 62/265 |
| 3,048,985 | 8/1962 | Long | 62/186 |
| 3,077,749 | 2/1963 | Jung et al. | 62/419 |
| 3,126,721 | 3/1964 | Shove | 62/408 |
| 3,364,694 | 1/1968 | Cohen et al. | 62/265 |
| 3,600,905 | 8/1971 | Dymek et al. | 62/382 |
| 4,241,589 | 12/1980 | Grimm et al. | 62/265 |
| 4,288,995 | 9/1981 | Grimm et al. | 62/382 |
| 4,539,819 | 9/1985 | Alba et al. | 62/408 |

*Primary Examiner*—Lloyd L. King

*Attorney, Agent, or Firm*—Christie, Parker & Hale

[57] ABSTRACT

A refrigerating apparatus is disclosed. The apparatus comprises a housing having at least one food storage compartment. A fan and an evaporator are provided for generating a stream of chilled air. A delivery duct carries the chilled air to a delivery vent opening in the food storage compartment and an air return duct carries air from a return vent opening in the food storage compartment back to the fan and evaporator. A food storage drawer is mounted in the food storage compartment and is slidably movable between an open and closed position. The drawer has inlet and outlet vent openings to positions adjacent the delivery and return vent openings when the drawer is in its closed position. Movable dampers are mounted adjacent each vent opening and are biased toward a closed position blocking the vent openings. Push rods are mounted on the ducts and the drawer which engage and open the dampers when the drawer is moved into its closed position thereby allowing air to flow between the delivery vent opening and the inlet opening and between the outlet opening and the return vent opening. When the drawer is moved out of its closed position, the springs bias the dampers to their closed positions.

20 Claims, 4 Drawing Figures

REFRIGERATOR APPARATUS

CROSS REFERENCE TO RELATED APPLICATIONS

This is a continuation of application Ser. No. 766,511 filed Aug. 19, 1985 now abandoned.

Field of the Invention

This invention relates to household refrigerators and more particularly a refrigerator having a plurality of food storage drawers whose temperatures can be individually controlled and which minimizes the amount of chilled air lost when the refrigerator is opened.

BACKGROUND OF THE INVENTION

Most conventional household refrigerators comprise a swing type door which opens to expose a large food storage compartment. The temperature of the compartment is typically maintained slightly above freezing by forced circulation of air over an evaporator and then into the compartment. When the door of the refrigerator is opened, a great deal of the chilled air escapes. As a result, a large amount of energy must be expended when the door is again shut to reduce the temperature of the storage compartment back to its normal operating temperature.

In conventional refrigerators, the temperature within the storage compartment is generally uniform throughout the compartment. Typically, the storage compartment is maintained at a temperature of about 38° F. It is preferred, however, to maintain fresh vegetables and meat at slightly lower temperatures, e.g. about 34° F. for fresh vegetables and about 30° F. for meat. Drawers are typically provided within the compartment for items such as vegetables, meat, cheese and the like, but the temperature within the drawers is generally about the same as the temperature throughout the rest of the storage compartment.

Accordingly, there is a need for a refrigerator which minimizes the loss of cool air which escapes when the refrigerator is opened and a further need for a refrigerator in which the temperatures of sub-compartments, e.g. for containing meat and vegetables within a large storage compartment, can be independently controlled.

SUMMARY OF THE INVENTION

Accordingly, there is provided a refrigerating apparatus comprising a housing having at least one food storage compartment defined by top, bottom, side and rear walls. A food storage drawer having front, rear, side and bottom walls is slidably disposed in the food storage compartment and is afforded slidable movement between a closed position in which the interior of the drawer is enclosed within the food storage compartment and an open position spaced apart forwardly from the closed position which provides access to the interior of the food storage compartment.

The refrigerating apparatus further comprises means for generating a stream of chilled air. An air delivery duct is provided which directs the stream of chilled air to the food storage compartment. The air delivery duct comprises a delivery vent opening within the food storage compartment. A return air duct having a return vent opening within the food storage compartment for returning air from the food storage compartment to the chilled air generating means.

Separate means are provided for automatically blocking the flow of air through the delivery vent opening and the return vent opening when the drawer is in an open position, i.e. not in its closed position, and for automatically unblocking the flow of air through the delivery vent opening and the return vent opening when the drawer is in its closed position.

In a preferred embodiment of the invention, the means for automatically blocking the delivery vent opening comprises a first damper hingedly attached to the air delivery duct adjacent the delivery vent opening and movable between a closed position blocking the delivery vent opening and an open position allowing air to flow through the delivery vent opening and means for biasing the first damper toward its closed position. Preferred means for unblocking the flow of air through the delivery vent opening when the drawer is in its closed position comprises a push rod mounted on the drawer so that it engages the first damper and moves the first damper to an open position when the drawer is moved from an open position to its closed position.

Likewise, the means for automatically blocking the return vent opening comprises a second damper hingedly attached to the air return duct adjacent the return vent opening and afforded movement between a closed position blocking the return vent opening and an open position which allows air to flow through the return vent opening. A second spring means biases the second damper toward its closed position. Preferred means for automatically unblocking the return vent opening comprises a second push rod mounted on the drawer so that it engages and moves the second damper to its open position when the drawer is moved into its closed position.

In a particularly preferred embodiment of the invention, the delivery vent opening and the return vent openings are at positions rearward of the rear wall of the drawer when the drawer is in its closed position. In such an embodiment, it is preferred that the rear wall of the drawer comprises inlet and outlet vent openings which are generally aligned with and adjacent to the delivery and return vent openings when the drawer is in its closed position. In such an arrangement, chilled air from the chilled air generating means flows through the air delivery duct, the delivery vent opening and the inlet vent opening into the food storage drawer. Air from the food storage compartment then flows through the outlet duct and return vent opening and through the return duct to the chilled air generating means.

In such an embodiment it is further preferred that the drawer comprise means for automatically blocking the inlet and outlet vent openings when the drawer is in an open position and for automatically unblocking the inlet and outlet vent openings when the drawer is moved into its closed position. Preferred blocking means comprise third and fourth movable dampers hingedly mounted on the drawer adjacent the inlet and outlet vent openings respectively, which, when the drawer is in its closed position, block the inlet and outlet vent openings. Third and fourth spring means bias the third and fourth dampers toward their closed positions.

Preferred means for unblocking the third and fourth dampers when the drawer is moved into its closed position comprises third and fourth push rods which are mounted at the back of the food storage compartment preferably to the air delivery duct and the air return duct respectively, and which extend forwardly into the inlet and outlet vent openings of the drawer to thereby engage the third and fourth dampers, and move the third and fourth dampers into open positions when the drawer is moved into its closed position.

In such a preferred embodiment of the invention, it is preferred that the lengths of the push rods be adjustable so that, when the drawer is in its closed position, the positions of the dampers can be adjusted to thereby control the amount of air flowing through the vent openings. It is further preferred that the apparatus comprise means, preferably flexible tubular gasket means, for directing air flowing out of the delivery vent opening into the inlet opening of the drawer and for directing air flowing out of the outlet opening of the drawer into the return vent opening.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
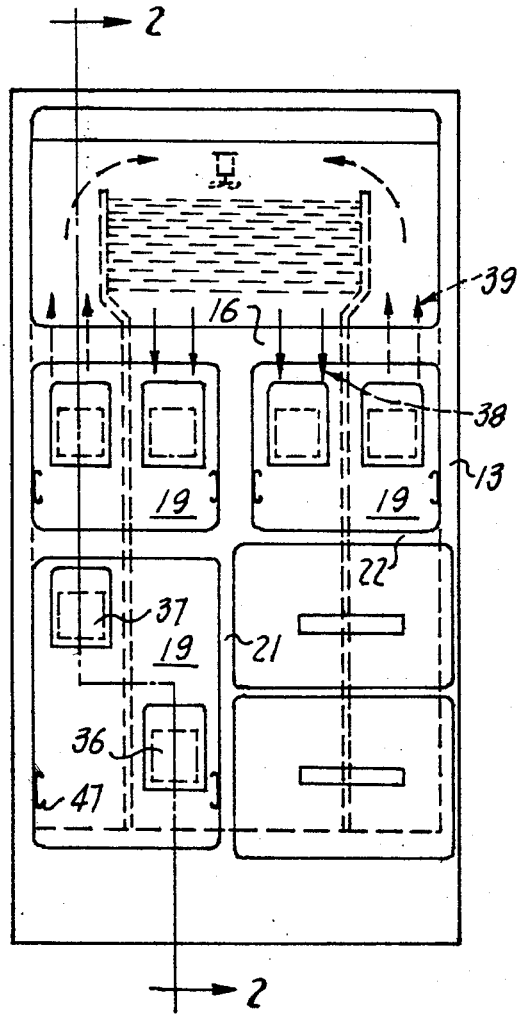
FIG. 1 is a front view of a preferred refrigerating apparatus having three drawers and the door to the freezer compartment removed.
Figure 2:
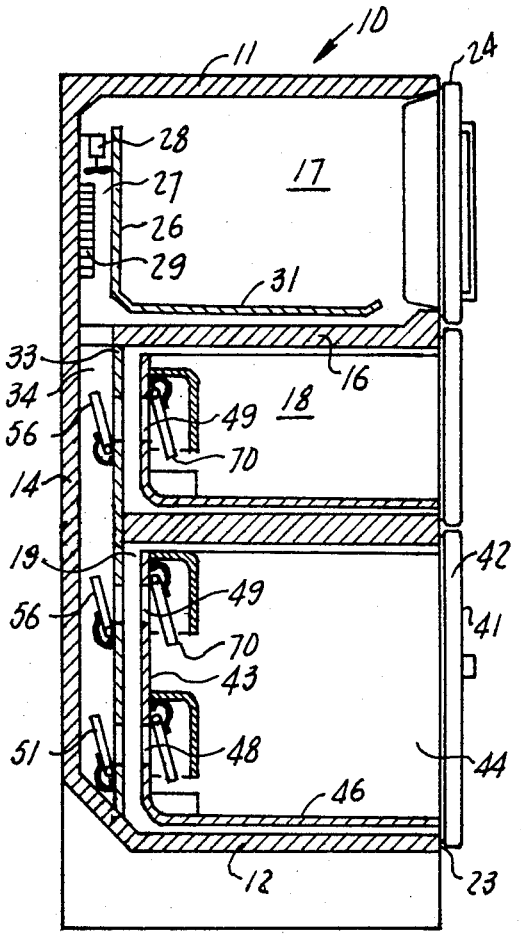
FIG. 2 is a side cross-sectional view of the refrigerating apparatus showing FIG. 1 taken through line 2—2.
Figure 3:
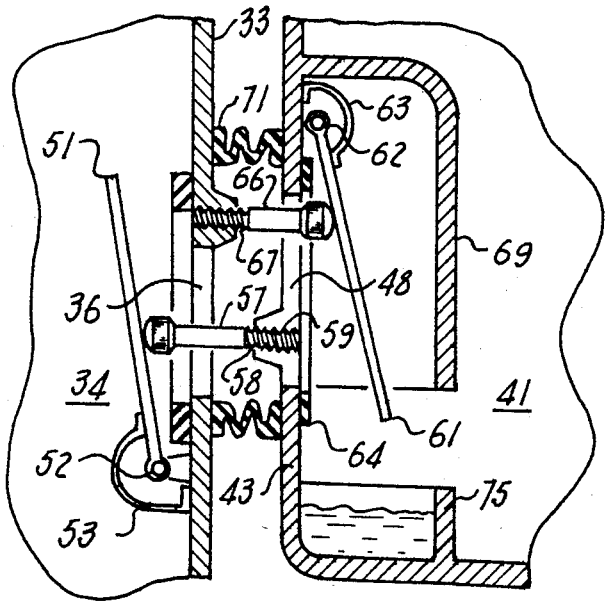
FIG. 3 is a fragmentary side cross-sectional view of a preferred vent opening arrangement.

A refrigerating apparatus constructed in accordance with the present invention is shown in FIGS. 1–3. The refrigerating apparatus comprises a housing 10 having a top wall 11, a bottom wall 12, a pair of side walls 13 and a rear wall 14. The interior of the refrigerator is divided by a generally horizontal divider 16 into an upper freezer compartment 17 and a lower refrigerator compartment 18. The lower refrigerator compartment 18 is divided into five food storage sub-compartments 19 by vertical partition 21 and three horizontal partitions 22. The forward edges of the partitions 21 and 22 along with the forward edges of the top, bottom and side walls 11, 12 and 13 respectively of the housing 10 form a generally flat front face 23 of the housing 10.

A swing-type door 24 is mounted on the housing 10 at the front of the freezer compartment 17 by hinges (not shown) and, when closed, encloses the freezer compartment 17. Within the freezer compartment 17, a generally vertical back panel 26 is mounted at a position spaced apart forwardly from the rear wall 14 of the housing 10, thereby forming a cooling chamber 27. A fan 28 and a cooling element 29, e.g. an evaporator, or the like, are mounted in the cooling chamber.

The back panel 26 extends from a generally horizontal lower edge spaced-apart from and above the horizontal divider 16 to a generally horizontal upper edge spaced-apart from and below the top wall 11 of the housing 10. A generally horizontal floor panel 31 on which food and the like can be placed extends forwardly from the lower edge of the back panel 26 and is spaced-apart above the horizontal divider 16. The floor panel 31 extends forwardly to a position spaced-apart from the forward end of the freezer compartment 17. The space in back of and below the back panel 26 and floor panel 31 forms a pathway for chilled air from the fan 28 and cooling element 29 to pass to the front of the freezer compartment 17. In the embodiment shown, air chilled by the cooling element passes downwardly under the floor panel 31 into the food storage area of the freezer compartment 17 and returns to the fan 28 and cooling element through the space between the top edge of the back panel 26 and the top wall 11 of the housing 10.

In the refrigerator compartment 18, there is provided a generally vertical rear panel 33 which is spaced apart from the rear wall 14 of the housing 10. The rear panel 33 forms the rear wall of each subcompartment 19. The space between the rear panel 33 and the rear wall 14 of the housing 10 forms a duct chamber 34.

Two openings, a delivery vent opening 36 and a return vent opening 37, are provided through the rear panel 33 between the duct chamber 34 and each subcompartment 19. An air delivery duct manifold 38 is provided in the duct chamber 34 and extends from each of the delivery vent openings 36 in the rear panel 33 through the horizontal divider 16 to the fan 28 and cooling element 29 in the cooling chamber 27 of the freezer compartment 17. Air chilled by the cooling element 29 is blown through the air delivery manifold 38 by the fan 28 and thereby delivered to each of the subcompartments 19 in the refrigerator compartment 18. An air return duct manifold 39 is also provided in the duct chamber 34 and extends from each of the return vent openings 37 through the horizontal divider 16 to the fan 28 and cooling element 29 in the freezer compartment 17. The air return duct manifold 39 returns air from these storage subcompartments 19 to the fan 28 and cooling element 29.

Each of the sub-compartments 19 of the refrigerator compartment 18 comprises a food storage drawer 41. Each food storage drawer 41 comprises front and rear walls 42 and 43, a pair of side walls 44, a bottom wall 46, and an open top. Each food storage drawer 41 is afforded slidable movement along a pair of laterally spaced apart generally horizontal rails 47 mounted on the side walls of the subcompartment 19, between a closed position in which the front wall 42 of the drawer 41 abuts the face 23 of the housing 10 and an open position spaced apart forwardly from the closed position which provides access to the interior of the drawer 41 for the removal of food stored therein.

The rear wall 43 of the drawer 41 comprises a pair of vent openings, an inlet vent opening 48, and an outlet vent opening 49. When the drawer 41 is in its closed position, the inlet vent opening 48 is aligned with and adjacent the delivery vent opening 36 in the rear panel 33 and the outlet vent opening 49 is aligned with and adjacent a position generally directly forward of the return vent opening 37 in the rear panel 33.

With reference to FIG. 3, first damper 51 is provided for controlling the flow of air through the delivery vent opening 36 in the rear panel 33. The first damper 51 is larger than the delivery vent opening 36 and is mounted on the rear panel 33 at a position below the delivery vent opening 36 by hinges 52. The first damper 51 is hingedly movable between a closed position which substantially prevents passage of air through the delivery vent opening 36 and an open position in which the first damper 51 extends into the delivery duct manifold 38 and which allows air to pass through the delivery vent opening 36. In such an arrangement, by adjusting the position of the first damper 51, in the open position, the size of the opening through the delivery vent opening 36 and hence, the amount of air flowing through delivery vent opening 36 can be controlled.

A first spring 53 biases the first damper 51 toward its closed position and a gasket 54 extends around the periphery of the delivery vent opening 36 between the first damper 51 and the rear panel 33 to form a seal between the first damper 51 and the rear panel 33 when the first damper 51 is in its closed position.

A second damper 56 is provided for controlling the flow of air through the return vent opening 37. The second damper 56 is mounted on the rear panel 33 in relation to the return vent opening 37 in the same manner as the first damper 51 is mounted in relation to the delivery vent opening 36.

When the food storage drawer 41 is in its closed position, the first damper 51 is maintained in an open position by a first push rod 57 which extends rearwardly from the rear wall 43 of the drawer 41. The first push rod 57 comprises a threaded shaft 58 which engages a threaded hole 59 in the rear wall 43 of the drawer 41. The first push rod 57 extends rearwardly through the delivery vent opening 36 in the rear panel 33 and engages the first damper 51, causing it to pivot on its hinge 52 to an open position.

The position of the first damper 51 when the drawer 41 is in its closed position is determined by the distance the first push rod 57 extends rearwardly from the rear wall 43 of the drawer 41. This distance can be adjusted by rotation of the first push rod 57. When the drawer 41 is moved forwardly to an open or partially open position, the first push rod 57 releases the first damper 51, the first spring 53 biases the first damper 51 to its closed position.

In like manner, when the drawer 41 is in its closed position, the second damper 56 is maintained in an open position by a second push rod (not shown) which extends rearwardly from the rear wall 43 of the drawer 41 and through the return vent opening 37 and engages the second damper 56.

The food storage drawer 41 also comprises a pair of dampers for regulating the flow of air through the inlet and outlet vent openings 48 and 49. Again with reference to FIG. 3, there is provided a third damper 61 pivotally mounted to the inside face of the rear wall 43 of the drawer 41 at a position above the inlet vent opening 48 by a hinge 62. The third damper 61 is hingedly movable between a closed position in abutment with the rear wall 43 of the drawer 41 and an open position extending into the drawer 41. A third damper 61 is larger than the inlet vent opening 48 and therefore substantially blocks passage of air through the inlet vent opening 48 when the third damper 61 is in its closed position and allows air to pass through the inlet vent opening 48 when it is in an open position. A third spring 63 biases the third damper 61 toward its closed position and a gasket 64 is provided around the periphery of the inlet vent opening 48 between the rear wall 43 of the drawer 41 and the third damper 61 to provide a seal between the rear wall 43 and the third damper 61 when the third damper 61 is in its closed position.

A third push rod 66 extends forwardly from the rear panel 33 into the inlet vent opening 48 when the drawer 41 is in its closed position. Like the first push rod 57, the third push rod 66 comprises a threaded shaft 67 which is threaded into a correspondingly threaded hole 68 in the rear panel 33. When the drawer 41 is in its closed position, the third push rod 66 engages the third damper 61 and maintains it in an open position. The angle of the third damper 61 can be adjusted by rotating the third push rod 66. A guard 69 is provided within the food storage drawer in surrounding relation to the third damper 61 to prevent food from contacting the third damper 61. The guard 69 is open at its bottom so that it does not obstruct the flow of air entering the food storage drawer 41 through the inlet vent opening 48.

When the drawer 41 is in its closed position, flexible tubular gasket 71 extends between the rear panel 33 and the rear wall 43 of the drawer 41 and forms an enclosed passageway between the delivery vent opening 36 in the rear panel 33 and the inlet vent opening 48 in the rear wall 43 of the drawer 41. The gasket 71 is fixedly attached at its rearward end to the rear panel 33 in surrounding relation to the delivery vent opening 36. The gasket 71 extends forwardly to a position so that, when the drawer is in its closed position, the forward end of the gasket 71 is in surrounding relation to the inlet vent opening 48.

The food storage drawer 41 comprises a fourth damper 70 (FIG. 2) for regulating the flow of air through the outlet vent opening 49. The fourth damper 70 is mounted on the rear wall of the drawer 41 in relation to the outlet vent opening 49 in the same manner as the third damper 61 is mounted in relation to the inlet vent opening 48. A fourth adjustable push rod (not shown) extends forwardly from the rear panel 33 through the outlet vent opening 49 to engage the fourth damper 70 when the food storage drawer 41 is in its closed position in a like manner as described for the third push rod 66. A second flexible gasket (not shown) extends between rear panel 33 and the rear wall 43 of the drawer 41 when the drawer 41 is in its closed position and forms an enclosed passageway between the outlet vent opening 49 and the return vent opening 37.

In the above arrangement, a flow of chilled air is generated by the fan 28 and cooling element 29. The chilled air is carried by the air delivery manifold 38 to the delivery vent opening 36 in the rear panel 33. The chilled air passes through the delivery vent opening 36, through the tubular gasket 71 and the inlet vent opening 48 into the food storage drawer 41. Air passes back to the fan 28 and cooling element 29 from the drawer 41 through the outlet vent opening 49, tubular gasket 71, return vent opening 37, and through the return duct manifold 39.

In a particularly preferred embodiment of the invention, a water tray 75 is located in the drawer below the inlet vent opening. The tray 75 can be filled with water if desired to increase the humidity within the drawer and achieve an almost vapor saturated condition.

In a preferred embodiment of the invention, all of the push rods are mounted on the drawer. That is, in addition to the first and second push rods, the third and fourth push rods are also mounted on and extend rearwardly from the drawer. The third and fourth push rods are mounted so that they are movable relative to the second and third dampers.

Figure 4:
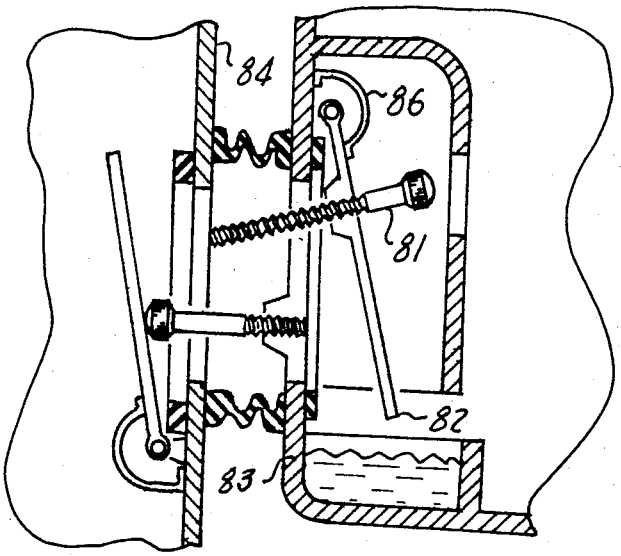
FIG. 4 is a fragmentary side cross-sectional view of another preferred vent opening arrangement.

For example, with reference to FIG. 4, the third push rod 81 is mounted on the third damper 82 of the food storage drawer 83. Rotation of the push rod 81 thereby adjusts the position of the rearward end of the push rod relative to the third damper 82.

The third push rod 81 is located so that as the drawer 83 is moved into its closed position, the rearward end of the third push rod 81 engages the partition 84 and causes the third push rod 81 to stop and as the drawer 83 continues to more rearwardly, the third damper 82 opens when the drawer 83 is moved forwardly away from the partition 84, the spring 86 causes the third damper 82 to close.

This embodiment provides the advantage that all four push rods associated with a drawer can be adjusted easily at the back of the drawer by simply removing the drawer.

In another particularly preferred embodiment of the invention, the springs which bias the dampers toward their closed positions are made of a metal alloy or composite which flexes or bends as a result of an increase in temperature. Such metal alloys and metal composites are well known and include memory metals, i.e., alloys that rapidly change from a cold-formed shape to a hot-formed shape when a critical temperature is reached, and thermostat metals, i.e., metal composites which bend in response to temperature change because of the difference in thermal expansion of the component members. In such an embodiment, the metal and the shape of the spring are selected so that when temperature at the vent openings increases as a result of the drawer being opened, the springs flex to thereby cause the dampers to close. When the drawer is closed and the temperature at the vent openings decreases, the springs resume their original position with the dampers open. Accordingly, there is no need for push rods or the like in such an embodiment.

The present invention provides several unique advantages. First, it minimizes the loss of chilled air when the apparatus is opened to provide access to food stored therein. When a conventional refrigerator is opened, the chilled air within the refrigerator, being colder and therefore heavier than the air outside of the refrigerator, flows downwardly out of the front of the refrigerator and is replaced by warm air. However, in the present invention, the cold air within the drawers is prevented from flowing downwardly by the side, front and rear walls of the drawer when the drawer is opened. In addition, escape of chilled air through the vent openings in the drawer is blocked when the drawer is opened. Since the chilled air is heavier than the surrounding warm air the amount of chilled air lost from the drawers when they are opened is minimized.

Further, by blocking the vent openings to the delivery and return ducts, the amount of chilled air lost from the refrigerator housing is minimized.

The present invention presents a means for regulating the temperature within each food storage drawer by regulating the position of the dampers when the drawers are in their closed positions. For example, lower temperatures can be obtained by adjusting the open position of the dampers to provide a larger opening through the vent opening thereby allowing more chilled air through to vent openings. Higher temperatures can be obtained by adjusting the open position of the dampers to thereby allow less chilled air through the vent openings.

The preceding description has been presented with reference to presently preferred embodiments of the invention shown in the accompanying drawings. Workers skilled in the art and technology to which this invention pertains will appreciate that alterations and changes in the described structures can be practiced without meaningfully departing from the principles, spirit and scope of this invention.

For example, it is apparent that the size and shape of the housing and the number and size of the drawers may vary. It is also apparent that the drawers need not be separated within the refrigerator compartment by partitions.

The apparatus may consist of food storage drawers only or may be in combination with food storage compartments having swing-type doors. This is particularly preferred for those refrigerators having food storage compartments at elevations sufficiently high to make drawers impractical. It is also apparent that the freezer compartment may comprise a food storage drawer in accordance with the present invention.

It is to be understood that any suitable means for mounting the drawers in the refrigerator compartment may be used. Preferably a suitable latch mechanism is used for releasably latching the drawers in their closed position.

Accordingly, the foregoing description should not be read as pertaining only to the precise structures and techniques described, but rather should be read consistent with and as support for the following claims which are to have their fullest fair scope.

What is claimed is:

1. A refrigerating apparatus comprising:

a housing having at least one food storage compartment;

means for generating a flow of chilled air;

an air delivery duct extending from the chilled air generating means to the food storage compartment for delivering chilled air from the chilled air generating means to the food storage compartment, said air delivery duct comprising at least one delivery vent opening within the food storage compartment;

a return duct extending from the food storage compartment to the chilled air generating means for return of air from the food storage compartment to the chilled air generating means, said return duct comprising at least one return vent opening in the food storage compartment;

at least one food storage drawer having front, rear, side and bottom walls and an open top slidably mounted in the food storage compartment and afforded slidable movement therein from a closed position wherein the interior of the drawer is enclosed within the food storage compartment and an open position spaced-apart forwardly from the closed position which provides access to the interior of the drawer; and means for automatically blocking the delivery vent opening and the return vent opening when the drawer is in its open position and for unblocking the delivery vent opening and return vent opening when the drawer is moved into its closed position.

2. A refrigerating apparatus as claimed in claim 1 wherein the means for automatically blocking the delivery vent opening and the return vent opening when the drawer is in its open position and for unblocking the delivery vent opening and return vent opening when the drawer is moved into its closed position comprises:

a first damper mounted within the storage compartment movable between a closed position blocking the delivery vent opening to thereby substantially prevent air from passing therethrough and an open position not blocking the delivery vent opening to thereby allow air to pass therethrough;

a second damper mounted within the storage compartment movable between a closed position blocking the return vent opening to thereby substantially prevent the flow of air therethrough and an open position not blocking the return vent opening to thereby allow air to flow therethrough;

spring means for biasing the first and second dampers toward their closed positions; and means for automatically engaging and moving the first and second dampers to their open positions when the drawer is moved into its closed position and for releasing the first and second dampers when the drawer is moved out of its closed position.

3. A refrigerating apparatus as claimed in claim 2 wherein the means for automatically engaging and moving the first and second dampers to their open positions when the drawer is moved into its closed position comprises:

a first push rod mounted on the drawer at a position whereby the first push rod engages and moves the first damper into its open position when the drawer is moved into its closed position; and a second push rod mounted on the drawer at a position whereby the second push rod engages and moves the second damper into its open position when the drawer is moved into its closed position.

4. A refrigerating apparatus as claimed in claim 1 wherein the drawer comprises an inlet vent opening and an outlet vent opening which are aligned with and adjacent the delivery vent opening and the return vent opening respectively when the drawer is in its closed position, and wherein the drawer further comprises means for automatically blocking the inlet vent opening and outlet vent opening when the drawer is in its open position and for unblocking the inlet vent opening and outlet vent opening when the drawer is moved into its closed position.

5. A refrigerating apparatus as claimed in claim 4 wherein the means for automatically blocking the inlet vent opening and outlet vent opening when the drawer is in its open position and for unblocking the delivery vent opening and return vent opening when the drawer is moved into its closed position comprises:

a third damper mounted on the drawer and movable between a closed position blocking the inlet vent opening to thereby substantially prevent air from passing therethrough and an open position not blocking the inlet vent opening to thereby allow air to pass therethrough;

a fourth damper mounted on the drawer and movable between a closed position blocking the outlet vent opening to thereby substantially prevent the flow of air therethrough and an open position not blocking the outlet vent opening to thereby allow air to flow therethrough;

spring means for biasing the third and fourth dampers toward their closed positions; and means for automatically engaging and moving the third and fourth dampers to their open positions when the drawer is moved into its closed position and for releasing the third and fourth dampers when the drawer is moved out of its closed position.

6. A refrigerating apparatus as claimed in claim 5 wherein the means for automatically engaging and moving the third and fourth dampers to their open positions when the drawer is moved into its closed position comprises:

a third push rod mounted in the food storage compartment at a position whereby the third push rod engages and moves the third damper into its open position when the drawer is moved into its closed position; and a fourth push rod mounted in the food storage compartment at a position whereby the fourth push rod engages and moves the fourth damper into its open position when the drawer is moved into its closed position.

7. A refrigerating apparatus as claimed in claim 5 wherein the refrigerating apparatus further comprises:

means for forming a first enclosed air passageway between the delivery vent opening and the inlet vent opening when the drawer is in its closed position; and means for forming a second enclosed air passageway between the return vent opening and the outlet vent opening when the drawer is in its closed position.

8. A refrigerating apparatus comprising:

a housing having at least one food storage compartment;

means for generating a flow of chilled air;

an air delivery duct extending from the chilled air generating means to the food storage compartment for delivering chilled air from the chilled air generating means to the food storage compartment, said air delivery duct comprising a delivery vent opening within the food storage compartment and a first damper movable between a closed position substantially blocking the flow of air through the delivery vent opening and an open position which allows air to pass through the delivery vent opening;

an air return duct extending from the food storage compartment to the chilled air generating means for return of air from the food storage compartment to the chilled air generating means, said return duct comprising a return vent opening in the food storage compartment and a second damper movable between a closed position substantially blocking the flow of air through the return vent opening and an open position which allows air to pass through the return vent opening;

at least one food storage drawer having front, rear, side and bottom walls and an open top slidably mounted in the food storage compartment and afforded slidable movement therein from a closed position wherein the interior of the drawer is enclosed within the food storage compartment and an open position spaced-apart forwardly from the closed position which provides access to the interior of the drawer;

means for automatically opening the first and second dampers when the drawer is moved into its closed position; and means for automatically closing the first and second dampers when the drawer is moved out of its closed position.

9. A refrigerating apparatus as claimed in claim 8 wherein the first damper is mounted by hinges on the air delivery duct at a position adjacent the delivery vent opening and the second damper is mounted by hinges on the air return duct at a position adjacent the return vent opening and the means for automatically closing the first and second dampers when the drawer is moved out of its closed position comprises first and second springs which bias the first and second dampers, respectively, toward their closed positions.

10. A refrigerating apparatus as claimed in claim 9 wherein the means for automatically opening the first and second dampers when the drawer is moved into its closed position comprises first and second push rods mounted on the drawer which engage the first and second dampers, respectively, and move the first and second dampers to their open positions when the drawer is moved into its closed position.

11. A refrigerating apparatus as claimed in claim 8 wherein the means for automatically opening the first and second dampers when the drawer is moved into its closed position and the means for automatically closing the first and second dampers when the drawer is moved out of its closed position comprises first and second members, each made of a metal which reversably bends from a first configuration to a second configuration as a result of the increase in temperature in the food storage compartment when the food storage drawer is opened, said first member being attached at one end to the air delivery duct and attached at its other end to the first damper so that the first damper is open when the first member is in its first configuration and the first damper is closed when the first member is in its second configuration and said second member being attached at one end to the air return duct and attached at its other end to the second damper so that the second damper is open when the second member is in its first configuration and the second damper is closed when the first member is in its second configuration.

12. A refrigerating apparatus as claimed in claim 8 wherein the drawer comprises an inlet vent opening and an outlet vent opening which are aligned with and adjacent the delivery vent opening and the return vent opening, respectively, when the drawer is in its closed position, and wherein the drawer further comprises:

a third damper movable between a closed position substantially blocking the flow of air through the inlet vent opening and an open position which allows air to pass through the inlet vent opening;

a fourth damper movable between a closed position substantially blocking the flow of air through the outlet vent opening and an open position which allows air to pass through the outlet vent opening;

means for automatically opening the third and fourth dampers when the drawer is moved into its closed position; and means for automatically closing the third and fourth dampers when the drawer is moved out of its closed position.

13. A refrigerating apparatus as claimed in claim 12 wherein the third and fourth dampers are mounted by hinges on the drawer at positions adjacent the inlet and outlet vent openings, respectively, and the means for automatically closing the third and fourth dampers when the drawer is moved out of its closed position comprises third and fourth springs which bias the third and fourth dampers, respectively, toward their closed positions.

14. A refrigerating apparatus as claimed in claim 12 wherein the means for automatically opening the third and fourth dampers when the drawer is moved into its closed position comprises third and fourth push rods mounted in the food storage compartment so that the third and fourth push rods engage the third and fourth dampers, respectively, and move the third and fourth dampers to their open positions when the drawer is moved into its closed position.

15. A refrigerating apparatus as claimed in claim 12 wherein the means for automatically opening the third and fourth dampers when the drawer is moved into its closed position and the means for automatically closing the third and fourth dampers when the drawer is moved out of its closed position comprises third and fourth members, each made of a metal which reversably bends from a first configuration to a second configuration as a result of the increase in temperature in the food storage drawer when the food storage drawer is opened, said third member being attached at one end to the drawer and attached at its other end to the third damper so that the third damper is open when the third member is in its first configuration and the third damper is closed when the third member is in its second configuration and said fourth member being attached at one end to the drawer and attached at its other end to the fourth damper so that the fourth damper is open when the fourth member is in its first configuration and the fourth damper is closed when the fourth member is in its second configuration.

16. A refrigerating apparatus as claimed in claim 12 wherein the refrigerating apparatus further comprises:

means for forming a first enclosed air passageway between the delivery vent opening and the inlet vent opening when the drawer is in its closed position; and means for forming a second enclosed air passageway between the return vent opening and the outlet vent opening when the drawer is in its closed position.

17. A refrigerating apparatus comprising:

a housing having at least one food storage compartment;

means for generating a flow of chilled air;

an air delivery duct extending from the chilled air generating means to the food storage compartment for delivering chilled air from the chilled air generating means to the food storage compartment, said air delivery duct comprising a delivery vent opening at the rear of the food storage compartment and a first damper hingedly mounted on the air delivery duct at a position adjacent the delivery vent opening movable between a closed position substantially blocking the flow of air through the delivery vent opening and an open position which allows air to pass through the delivery vent opening;

an air return duct extending from the food storage compartment to the chilled air generating means for return of air from the food storage compartment to the chilled air generating means, said return duct comprising a return vent opening at the rear of the food storage compartment and a second damper hingedly mounted on the air return duct at a position adjacent the return vent opening movable between a closed position substantially blocking the flow of air through the return vent opening and an open position which allows air to pass through the return vent opening;

at least one food storage drawer having front, rear, side and bottom walls and an open top slidably mounted in the food storage compartment and afforded slidable movement therein from a closed position wherein the interior of the drawer is enclosed within the food storage compartment and an open position spaced-apart forwardly from the closed position which provides access to the interior of the drawer, said drawer further comprising inlet and outlet vent openings in the rear wall of the drawer which are aligned with and adjacent the delivery vent opening and the return vent opening, respectively, when the drawer is in its closed position, a third damper hingedly mounted on the rear wall at a position adjacent the inlet opening movable between a closed position substantially blocking the flow of air through the inlet vent opening and an open position which allows air to pass through the inlet vent opening and a fourth damper hingedly mounted on the rear wall at a position adjacent the outlet opening movable between a closed position substantially blocking the flow of air through the outlet vent opening and an open position which allows air to pass through the outlet vent opening;

means for forming a first enclosed air passageway between the delivery vent opening and the inlet vent opening when the drawer is in its closed position;

means for forming a second enclosed air passageway between the return vent opening and the outlet vent opening when the drawer is in its closed position;

means for automatically opening the first, second, third and fourth dampers when the drawer is moved into its closed position; and means for automatically closing the first, second, third and fourth dampers when the drawer is moved out of its closed position.

18. A refrigerating apparatus as claimed in claim 17 wherein the means for automatically closing the first, second, third and fourth dampers when the drawer is moved out of its closed position comprises first, second, third and fourth springs which bias the first, second, third and fourth dampers, respectively, toward their closed positions.

19. A refrigerating apparatus as claimed in claim 18 wherein the means for automatically opening the first, second, third and fourth dampers when the drawer is moved into its closed position comprises first and second push rods mounted on the rear wall of the drawer which engage the first and second dampers, respectively, and move the first and second dampers to their open positions when the drawer is moved into its closed position and third and fourth push rods mounted on the air delivery duct and air return duct, respectively, so that the third and fourth push rods engage the third and fourth dampers, respectively, and move the third and fourth dampers to their open positions when the drawer is moved into its closed position.

20. A refrigerating apparatus as claimed in claim 17 wherein the means for automatically opening the first, second, third and fourth dampers when the drawer is moved into its closed position and the means for automatically closing the first, second, third and fourth dampers when the drawer is moved out of its closed position comprises first, second, third and fourth members, each made of a metal which reversably bends from a first configuration to a second configuration as a result of the increase in temperature in the food storage compartment and food storage drawer when the food storage drawer is opened, said first member being attached at one end to the air delivery duct and attached at its other end to the first damper so that the first damper is open when the first member is in its first configuration and the first damper is closed when the first member is in its second configuration, said second member being attached at one end to the air return duct and attached at its other end to the second damper so that the second damper is open when the second member is in its first configuration and the second damper is closed when the first member is in its second configuration, said third member being attached at one end to the rear wall of the drawer and attached at its other end to the third damper so that the third damper is open when the third member is in its first configuration and the third damper is closed when the third member is in its second configuration and said fourth member being attached at one end to the rear wall of the drawer and attached at its other end to the fourth damper so that the fourth damper is open when the fourth member is in its first configuration and the fourth damper is closed when the fourth member is in its second configuration.

* * * * *